US005294588A

United States Patent [19]

Mori et al.

[11] Patent Number: 5,294,588

[45] Date of Patent: Mar. 15, 1994

[54] SHEET FOR SUBLIMATION TRANSFER

[75] Inventors: Masukuni Mori; Osamu Sakurai, both of Bisai, Japan

[73] Assignee: Tsuyakin Co., Ltd., Aichi, Japan

[21] Appl. No.: 896,046

[22] Filed: Jun. 8, 1992

[51] Int. Cl.[5] ..... B41M 5/035; B41M 5/38

[52] U.S. Cl. ..... 503/227; 428/195; 428/500; 428/524; 428/913; 428/914

[58] Field of Search ..... 8/471; 428/195, 483, 428/524, 913, 914, 500; 503/227

[56] References Cited

U.S. PATENT DOCUMENTS

| | | | |
|---|---|---|---|
| 4,650,494 | 3/1987 | Kutsukake et al. | 8/471 |
| 4,902,670 | 2/1990 | Kanto et al. | 503/227 |
| 5,068,282 | 11/1991 | Kanto et al. | 525/61 |

FOREIGN PATENT DOCUMENTS

| | | | |
|---|---|---|---|
| 101087 | 6/1985 | Japan | 503/227 |
| 151484 | 6/1988 | Japan | 503/227 |

*Primary Examiner*—B. Hamilton Hess

*Attorney, Agent, or Firm*—Wenderoth, Lind & Ponack

[57] ABSTRACT

A sheet for sublimation transfer has an ink layer formed one side of a material sheet. A sublimation transfer ink forming the ink layer contains a binder which does not melt onto a printing medium, such as a printing paper, to which an image is transferred, and will not cause transfer of dyes to the backside of the sheet even when the sheet is rolled and placed in relatively high temperature environment for a long period of time. The binder is composed of vinyl acetal group (X), vinyl alcohol group (Y) ,and vinyl acetate group (Z) as expressed by the following formula (I):

(I)

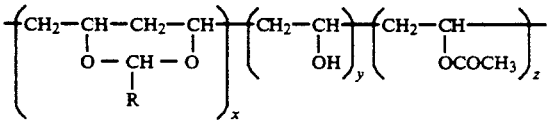

wherein R of said polyvinyl acetal resin is $C_nH_{2n+1}$, where n is zero or a positive integer greater than or equal to 4.

10 Claims, No Drawings

SHEET FOR SUBLIMATION TRANSFER

BACKGROUND OF THE INVENTION

1. Field of the Invention

The present invention relates to a sheet for sublimation transfer to be used in a thermal transfer recording apparatus, such as a thermal printer, a thermal typewriter, a laser printer and so forth.

2. Description of the Prior Art

In such kind of a sheet for sublimation transfer, a lubricative heat resisting layer is provided on the backside of a material sheet. An ink layer is formed on the surface of the sheet by coating an ink containing dispersing dyes or the like which sublimate by heating. From the backside of the sheet where the lubricative heat resisting layer is formed, thermal transfer corresponding to an image information is performed by means of a thermal head, laser or so forth to transfer the image on to an object, to which the image is to be transferred.

Conventionally, the ink contains a binder in addition to sublimation type dyes. As such binder, in addition to a saturated polyester resin, polycarbonate resin, cellulosic resin, polyvinyl acetoacetal resin (Japanese Patent Laid Open (Kokai) No. 63-151484) and polyvinyl butyral resin (Japanese Patent Laid Open (Kokai) No. 60-101087) among polyvinyl acetal resins are used.

Namely, in the following formula (I) expressing a vinyl acetal group (X), polyvinyl acetoacetal resin contains $CH_3$ as alkyl group R and polyvinyl butyral resin contains $C_3H_7$.

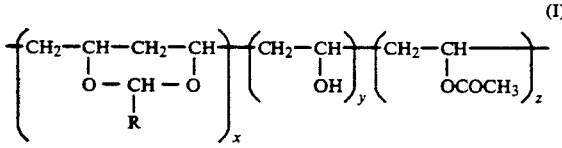

(I)

Among the conventional binders saturated polyester resin or polycarbonate resin have relatively high capability of dispersing dyes. However, these resins are defective in a tendency of melting on a printing paper during thermal transfer. On the other hand, polyvinyl acetoacetal resin, polyvinyl butyral resin, or the cellulosic resin, such as ethyl cellulose, propyl cellulose and the like have a property of hardly melting on the printing paper. However, these binder materials have a defect in insufficient holding capability of the dispersing dyes. For instance, the above-mentioned binders are added to respective inks of yellow, magenta, and cyan. Then, respective ink is coated on a material sheet in order of yellow, magenta and cyan to prepare a sheet for sublimation transfer. Then such sheet is wound on a tube of vinyl chloride having a diameter of 1 inch for a plurality of turns, and maintained within a thermostatic chamber at 60° C. for 96 hours. Then, there is observed a dye transferring phenomenon to transfer the dispersing dyes forming yellow, magenta and cyan in the ink layer to the lubricative heat resisting layer on the backside of the material sheet.

SUMMARY OF THE INVENTION

Therefore, it is an object of the present invention to provide a sheet for sublimation transfer which will not melt on a printing paper during thermal printing, and in which ink will never be transferred to a lubricative heat resisting layer on the backside of the material sheet even when it is left in piled condition by being wound for a plurality of times, under higher temperature condition which is higher than a room temperature.

In order to accomplish the above-mentioned object, a sheet is provided for sublimation transfer, having a lubricative heat resisting layer on one side of a material sheet and an ink layer formed on the other side of the material sheet, which ink layer is formed by coating a sublimation transfer ink containing binder composed of vinyl acetal group (X), vinyl alcohol group (Y), and vinyl acetate group (Z) as expressed by the following formula (I):

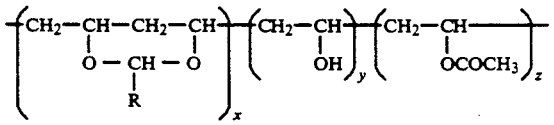

(I)

wherein R of said polyvinyl acetal resin is H, $C_2H_5$ or an alkyl group of 4 or more carbon atoms.

The sublimation transfer ink to be used for forming the ink layer of the present invention is prepared by solving a sublimation type dispersing dye with the above-mentioned binder and then coating it on one side of the material sheet by a solvent.

The binder may be selected from polyvinyl formal having H as group R, polyvinyl propyral having $C_2H_5$ as alkyl group, or polyvinyl pental ($R=C_4H_9$), polyvinyl hexal ($R=C_5H_{11}$), polyvinyl heptal ($R=C_6H_{13}$) or polyvinyl acetal having a greater number of carbon atoms, as the alkyl group R. When an isocyanate compound is preferably mixed with the binder, isocyanate group of the isocyanate compound forms urethane coupling with hydroxyl group of the binder to enhance capability of holding dyes.

Composition of the ink is preferred to contain, with respect to total amount of ink 100 wt part, 3~15 wt part of dyes, 1~50 wt part of the binder, 0 to 50 wt part of the isocyanate compound, 96~50 wt part of the solvent.

Further preferably, an anchor coating is preliminarily provided on the surface, on which the ink is to be coated. The anchor coating agent is preferably prepared by solving the binder with a solvent. Also, it is further preferred to include isocyanate compound with the binder.

As the solvent for the ink, the lubricative heat resisting agent or the anchor coating agent, a known solvent, such as toluene, methyl ethyl ketone or so forth can be used.

As the material sheet for the present invention, a plastic film in a thickness approximately 2 to 25 μm, such as polyester, polyimide, polysulfone, polystyrene, polycarbonate or so forth, can be used.

It is known to those skilled in the art that a glass transition point becomes higher as a greater number of carbon atoms is present in the alkyl group R in the vinyl acetal group (X), namely as there is a greater molecular weight per vinyl acetal monomer, and as a greater number of the vinyl acetal groups (X) is present, namely as there is a greater polymerization degree. By providing a composition ratio greater than or equal to 15~20% of vinyl alcohol group (Y) in the molecular chain, hydroxyl group (—OH) in the vinyl alcohol group may promote stabilization of electron density in the dye molecule and act to maintain coupling of polar component of the dye molecule and hydrogen. However, in case of vinyl acetoacetal ($R=CH_3$) or vinyl butyral ($R=C_3H_7$) having number of carbon atoms, $n=1$ or $n=3$, or in case of vinyl formal ($R=H$) or vinyl propyral ($R=C_2H_5$) having number of carbon atoms, $n=0$ or $n=2$, among normally known vinyl acetal group (X), number of carbon atoms is less than or equal to 3which results in a small molecular weight and low glass transition point. Also, at the same time, there is a tendency to lower content ratio of hydroxyl group (—OH) in vinyl alcohol group to make shelf life unstable. Among vinyl acetal group (X) containing carbon atoms less than or equal to 3 in alkyl group, vinyl formal ($R=H$) and vinyl propyral ($R=C_2H_5$ at $n=0$ or $n=2$), the polymerization degree is required to establish molecular chain to maintain the polymerization degree greater than or equal to 1000, and to have content ratio of the hydroxyl group (—OH) in the vinyl alcohol group (Y) greater than or equal to approximately 10 to 15%. In case of the polyvinyl acetal having greater than or equal to 4 carbon atoms in alkyl group R in vinyl acetal group (X), the composition may have high glass transition point. In addition, in case of vinyl acetal group having 0 or 2 carbon atoms in alkyl group R, high glass transition point can be obtained by making the polymerization degree greater than or equal to 1,000, at least. Also, it becomes possible to select binder for ink having high holding ability of dyes by hydrogen coupling between appropriate amount of hydroxyl group (—OH) in the vinyl alcohol group (Y) in the molecular chain, and molecule of the dyes. Accordingly, with high glass transition point or high polymerization degree, thermal transfer can be easily done without causing melting of the binder component onto the printing paper during thermal printing. Furthermore, according to the present invention, improved shelf life can be provided. According to rising temperature by heating during transfer, respective dye molecules initiates vaporization behavior by weakening of hydrogen coupling force with hydroxyl group (—OH) in vinyl alcohol group (Y) of the molecular chain. Then, the distance between molecules is progressively expanded. At this time, with hydrophilic activation behavior of hydroxyl group (—OH) in vinyl alcohol group (Y), the polar energy acts as reacting force for vaporizing non-polar dye molecules to promote sublimating behavior of the dye molecules. Therefore, sublimation transfer force for transferring dyes onto the printing paper is activated to obtain high density transferred image with high efficiency. In addition, the sheet for sublimation transfer according to the present invention will never cause transfer of ink to the lubricative heat resisting layer on the backside of the material when the sheet is rolled to pile a plurality of sheets even under higher temperature condition than the room temperature.

Particularly, by mixing isocyanate compound with the binder, isocyanate group in isocyanate compound establishes urethane coupling with hydroxyl group of the binder to further increase dye holding force to further completely avoid dye transferring phenomenon.

EXAMPLES

Discussion will be given herebelow with respect to examples implementing the present invention. In the following discussion, the unit "part" represents "weight part".

EXAMPLE 1

After coating an ink having the following composition on one side of a polyester film having thickness of 6 μm by 200 mesh gravure coating, the film is left at 40° C. for one week to form a lubricative heat resisting layer of 0.4 μm thickness.

| | |
|---|---|
| BINDER | |
| A801 (Dainippon Ink Kagaku K.K., Acryl Polyohol) | 4 parts |
| ISOCYANATE COMPOUND | |
| Takenate D-110N (Takeda Yakuhin K.K.) | 1 part |
| SURFACTANT AND LUBRICANT | |
| Homogenol L-18 (Kao K.K.) | 0.5 parts |
| PHOSPHATE METAL SALT | |
| Gafac RD-720 (Toho Kagaku K.K.) | 0.5 parts |
| SOLVENT | |
| methyl ethyl ketone | 94.0 parts |

Next, on the opposite side of the polyester film, an anchor coat agent having the following composition was coated by a gravure coater, and dried to form an anchor coat layer of 0.2 μm thickness.

| | |
|---|---|
| BINDER | |
| Denka polyvinyl propyral BY-111 (Denki Kagaku K.K.) | 2.0 parts |
| ISOCYANATE COMPOUND | |
| Takenate D-110N (Takeda Yakuhin K.K.) | 2.0 parts |
| SOLVENT | |
| ethyl acetate | 96.0 parts |

After coating the anchor coat agent, the film is left at the room temperature for three days. After sufficient aging, four kinds of inks blended with the following materials were coated for respective 17.3 cm length over overall width in order of yellow, magenta, cyan and black to obtain the thermal printing sheet.

| | |
|---|---|
| (a) Yellow Ink | |
| DYES | |
| MS Yellow VP (Mitsui Toatsu Senryo K.K.) | 2.0 parts |
| DYES | |
| Macrolex Yellow 3G (C.I. Solvent Yellow 93) (Byer) | 2.0 parts |
| BINDER | |
| Denka polyvinyl propyral BY-111 (Denki Kagaku K.K.) | 4.0 parts |
| ISOCYANATE COMPOUND | |
| Takenate D-110N (Takeda Yakuhin K.K.) | 1.0 part |
| COAT PROMOTING SURFACE IMPROVING AGENT | |
| Defenser MCF-323 (Dainippon Ink K.K.) | 0.2 parts |
| SOLVENT | |
| Toluene | 90.8 parts |
| (b) Magenta Ink | |
| DYES | |
| Resirene Red TB (C.I. Disperse Red 60) (Byer) | 2.0 parts |
| DYES | |
| Macrolex Red Violet R (C.I. Disperse Violet 31) (Byer) | 1.0 part |
| DYES | |
| MS Magenta VP (Mitsui Toatsu Senryo K.K.) | 2.0 parts |
| BINDER | |
| Denka polyvinyl pental AY-20 (Denki Kagaku K.K.) | 3.0 parts |
| ISOCYANATE COMPOUND | |
| Takenate D-110N (Takeda Yakuhin K.K.) | 0.5 parts |
| COAT PROMOTING SURFACE IMPROVING AGENT | |
| Defenser MCF-323 (Dainippon Ink K.K.) | 0.2 parts |
| SOLVENT | |
| Toluene | 91.3 parts |
| (c) Cyan Ink | |

-continued

| | |
|---|---|
| DYES | |
| MS Cyan VP (Mitsui Toatsu Senryo K.K.) | 3.0 parts |
| DYES | |
| MS Cyan VPG (Mitsui Toatsu Senryo K.K.) | 1.0 part |
| DYES | |
| Ceres Blue GN | 3.0 parts |
| (C.I. Solvent Blue 63) (Byer) | |
| DYES | |
| Foron Brilliant Blue S-R PIPK | 0.5 parts |
| (C.I. Disperse Blue 354) (Sando) | |
| BINDER | |
| Denka polyvinyl hexal AY21 (Denki Kagaku K.K.) | 4.0 parts |
| ISOCYANATE COMPOUND | |
| Takenate D-110N | 2.0 parts |
| SOLVENT | |
| methyl ethyl ketone | 40.0 parts |
| SOLVENT | |
| toluene | 46.5 parts |
| (d) Black Ink | |
| DYES | |
| Foron Brilliant Blue S-R PIPK | 5.0 parts |
| (C.I. Disperse Blue 354) (Sando) | |
| DYES | |
| Foron Rubine SE-GFL PIPK | 2.5 parts |
| (C.I. Disperse Red 73) (Sando) | |
| DYES | |
| Foron Brilliant Yellow S-6GL PIPK | 2.5 parts |
| (C.I. Disperse Yellow 231) (Sando) | |
| BINDER | |
| Denka polyvinyl heptal AY22 (Denki Kagaku K.K.) | 2.0 parts |
| Denka polyvinyl Propyral BY-111 (Denki Kagaku K.K.) | 2.0 parts |
| ISOCYANATE COMPOUND | |
| Takenate D-110N (Takeda Yakuhin K.K.) | 1.0 part |
| SOLVENT | |
| dichloromethane | 85.0 parts |

EXAMPLE 2

After coating an ink having the following composition on one side of a polyester film having thickness of 6 μm by 200 mesh gravure coating, the film is left at 40° C. for one week to form a lubricative heat resisting layer of 0.4 μm thickness.

| | |
|---|---|
| BINDER | |
| A815-45 (Dainippon Ink Kagaku K.K., Acryl Polyohol) | 2.00 parts |
| silicon oil L-722 (Shin-etsu Kagaku K.K.) | 0.05 parts |
| ISOCYANATE COMPOUND | |
| Takenate D-110N (Takeda Yakuhin K.K.) | 1.00 part |
| PHOSPHATE METAL SALT | |
| Gafac RD-720 (Toho Kagaku K.K.) | 1.00 part |
| SOLVENT | |
| methyl ethyl ketone | 95.95 parts |

Next, on the opposite side of the polyester film, an anchor coat agent having the following composition was coated by a gravure coater, and dried to form an anchor coat layer of 0.2 μm thickness.

| | |
|---|---|
| BINDER | |
| Denka polyvinyl propyral BY-111 (Denki Kagaku K.K.) | 2.0 parts |
| ISOCYANATE COMPOUND | |
| Takenate D-110N (Takeda Yakuhin K.K.) | 2.0 parts |
| SOLVENT | |
| methyl ethyl ketone | 96.0 parts |

After coating the anchor coat agent, the film is left at the room temperature for three days. After sufficient aging, three kinds of inks blended with the following materials were coated for respective 32.6 cm length over overall width in order of yellow, magenta, and cyan to obtain the thermal printing sheet.

| | |
|---|---|
| (a) Yellow Ink | |
| DYES | |
| MS Yellow VP (Mitsui Toatsu Senryo K.K. | 3 parts |
| BINDER | |
| Denka polyvinyl propyral BY-111 (Denki Kagaku K.K.) | 4 parts |
| ISOCYANATE COMPOUND | |
| Takenate D-110N (Takeda Yakuhin K.K.) | 1 part |
| SOLVENT | |
| 1,4-dioxane | 92 parts |
| (b) Magenta Ink | |
| DYES | |
| MS Magenta VP (Mitsui Toatsu Senryo K.K.) | 3 parts |
| BINDER | |
| Denka polyvinyl propyral BY-111 (Denki Kagaku K.K.) | 4 parts |
| ISOCYANATE COMPOUND | |
| Takenate D-110N (Takeda Yakuhin K.K.) | 1 part |
| SOLVENT | |
| 1,4-dioxane | 92 parts |
| (c) Cyan Ink | |
| DYES | |
| MS Cyan VPG (Mitsui Toatsu Senryo K.K.) | 4 parts |
| BINDER | |
| Denka polyvinyl propyral BY-111 (Denki Kagaku K.K.) | 5 parts |
| ISOCYANATE COMPOUND | |
| Takenate D-110N (Takeda Yakuhin K.K.) | 1 part |
| SOLVENT | |
| 1,4-dioxane | 90 parts |

The sheets for sublimation transfer obtained through the examples 1 and 2 were wound on a vinyl chloride tube having 1 inch diameter for a plurality of turns to form samples. The samples were placed in a thermostatic chamber and left for continuous hours at 60° C. of temperature. As a result, it has been found that no dyes transfer to the lubricative heat resisting layer on the backside of the sheet. This demonstrates high performance of holding dyes. In the thermal printing, melting of the binder component had not been caused.

Although the invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiments set out above but to include all possible embodiments within a scope encompassed, and equivalents thereof, with respect to the features set out in the appended claims.

What is claimed is:

1. A sheet for sublimation transfer, having a lubricative heat resisting layer on one side of a material sheet and an ink layer formed on the other side of the material sheet, which ink layer is formed by coating a sublimation transfer ink containing binder consisting of polyvinyl acetal resin composed of 80% or more of vinyl acetal group X, 15–20% of vinyl alcohol group Y, and less than 2% of vinyl acetate group Z with respect to a total amount of 100% of said resin, wherein said vinyl acetal group X, vinyl alcohol group Y, and vinyl acetate group Z are expressed by the following formula (I):

(I)

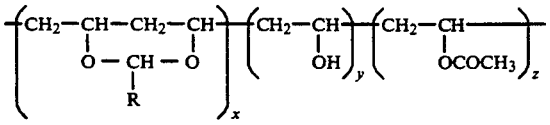

wherein R is an alkyl group of the formula $C_nH_{2n+1}$, where n is a positive integer of greater than or equal to 2.

2. A sheet for sublimation transfer as set forth in claim 1, wherein said polyvinyl acetal resin has a polymerization degree of greater than or equal to 2,400.

3. A sheet for sublimation transfer as set forth in claim 1, in which an anchor coating is preliminarily provided on the surface, on which the ink is to be coated.

4. A sheet for sublimation transfer as set forth in claim 3, wherein the anchor coating agent is prepared by solving the binder with a solvent.

5. A sheet for sublimation transfer as set forth in claim 3, wherein a solvent is used in forming the ink, the lubricative heat resisting layer and the anchor coating, and either the solvent for the ink, the lubricative heat resisting layer or the anchor coating is selected from the group consisting of toluene and methyl ethyl ketone.

6. A sheet for sublimation transfer as set forth in claim 1, in which an isocyanate compound is mixed with the binder.

7. A sheet for sublimation transfer as set forth in claim 6, in which an isocyanate group of the isocyanate compound forms a urethane coupling with a hydroxyl group of the binder to enhance capability of holding dyes.

8. A sheet for sublimation transfer as set forth in claim 1, wherein said material sheet is a plastic film in a thickness of approximately 2 to 25 μm.

9. A sheet for sublimation transfer as set forth in claim 8, wherein said plastic film is formed of a material selected from the group consisting of polyester, polyimide, polysulfone, polystyrene and polycarbonate.

10. A sheet for sublimation transfer as set forth in claim 1, wherein the ink has a composition, with respect to a total amount of 100 wt parts of ink, of 3–15 wt parts of dye, 1–50 wt parts of binder, 0–50 wt parts of isocyanate compound, and 96–50 wt parts of solvent.

* * * * *